US005544384A

United States Patent [19]

Forselius et al.

[11] Patent Number: 5,544,384

[45] Date of Patent: Aug. 13, 1996

[54] WALL CORNER FINISHING TOOL

[76] Inventors: Frank E. Forselius, 925 Vera Ave., Redwood City, Calif. 94061; Kenneth Tarlow, 94 Birch Ave., Corte Madera, Calif. 94925

[21] Appl. No.: 387,163

[22] Filed: Feb. 13, 1995

[51] Int. Cl.[6] ..... B05C 17/10; E01C 19/12

[52] U.S. Cl. ..... 15/235.7; 15/235.8; 425/458

[58] Field of Search ..... 15/235.4, 235.7, 15/235.8; 425/87, 458

[56] References Cited

U.S. PATENT DOCUMENTS

| | | | |
|---|---|---|---|
| 109,073 | 11/1870 | Streeter | 15/235.8 |
| 1,370,060 | 3/1921 | Smith | 15/235.8 |
| 2,178,899 | 11/1939 | Shaffer | 15/235.8 |
| 4,757,572 | 7/1988 | Yon | 15/235.8 |
| 5,192,558 | 3/1993 | Sparrow et al. | 15/235.8 |
| 5,442,832 | 8/1995 | Tonsager | 15/235.7 |
| 5,467,497 | 11/1995 | Greene et al. | 15/235.8 |

*Primary Examiner*—David Scherbel
*Assistant Examiner*—Randall E. Chin
*Attorney, Agent, or Firm*—Jack Lo

[57] ABSTRACT

A wall corner finishing tool includes a pair of plastic blades connected by a living hinge. The proximal ends of a pair of arcuate arms are hingeably connected to the back sides of the blades. The arms are curved toward each other so as to overlap at their intersection. The arms include longitudinal openings extending therethrough. A handle is attached to the intersection of the arms by a screw extended through the openings and into one end of the handle. When the screw is loosened, the arms can be moved toward or away from each other to adjust the angle between the blades. When the blades are positioned at a desired angle, the screw can be tightened to fix them in position. The blades can be adjusted for finishing wall corners of a great variety of angles.

9 Claims, 5 Drawing Sheets

WALL CORNER FINISHING TOOL

BACKGROUND OF THE INVENTION

1. Field of the Invention

This invention relates generally to tools for finishing dry wall boards, specifically to a tool for finishing wall corners of different angles.

2. Prior Art

A plasterer's trowel is a tool for smoothing and shaping wet plaster in wall corners during building construction. U.S. Pat. No. 4,619,013 (1986) disclose an example. However, typical trowels are not adaptable to a variety of internal and external corners that are found in modern buildings.

OBJECTS OF THE INVENTION

Accordingly the primary object of the present invention is to provide a wall corner finishing tool for finishing wall corners in a great range of angles.

Another object of the present invention is to provide a wall corner finishing tool that is very easy to clean.

Yet another object of the present invention is to provide a wall corner finishing tool that provides a smooth working surface.

Still another object of the present invention is to provide a wall conrer finishing tool that is comfortable to hold.

Further objects of the present invention will become apparent from a consideration of the drawings and ensuing description.

SUMMARY OF THE INVENTION

A wall corner finishing tool includes a pair of integral blades connected by a living hinge. A pair of arcuate arms each has one end hingeably connected to the back of one blade, and an opening extending along its length. The arms extend toward each other and overlap. A handle is attached to the intersection of the arms by a screw extended through the openings and into one end of the handle. When the screw is loosened, the arms can be slid toward or away from each other to adjust the angle of the blades. When the blades are positioned at a desired angle, the screw can be tightened to hold the blades in position. The angle between the front or working surfaces of the blades can be adjusted between 20 to 340 degrees. The integral living hinge connecting the pair of blades provides a smooth working surface.

Figure 1:
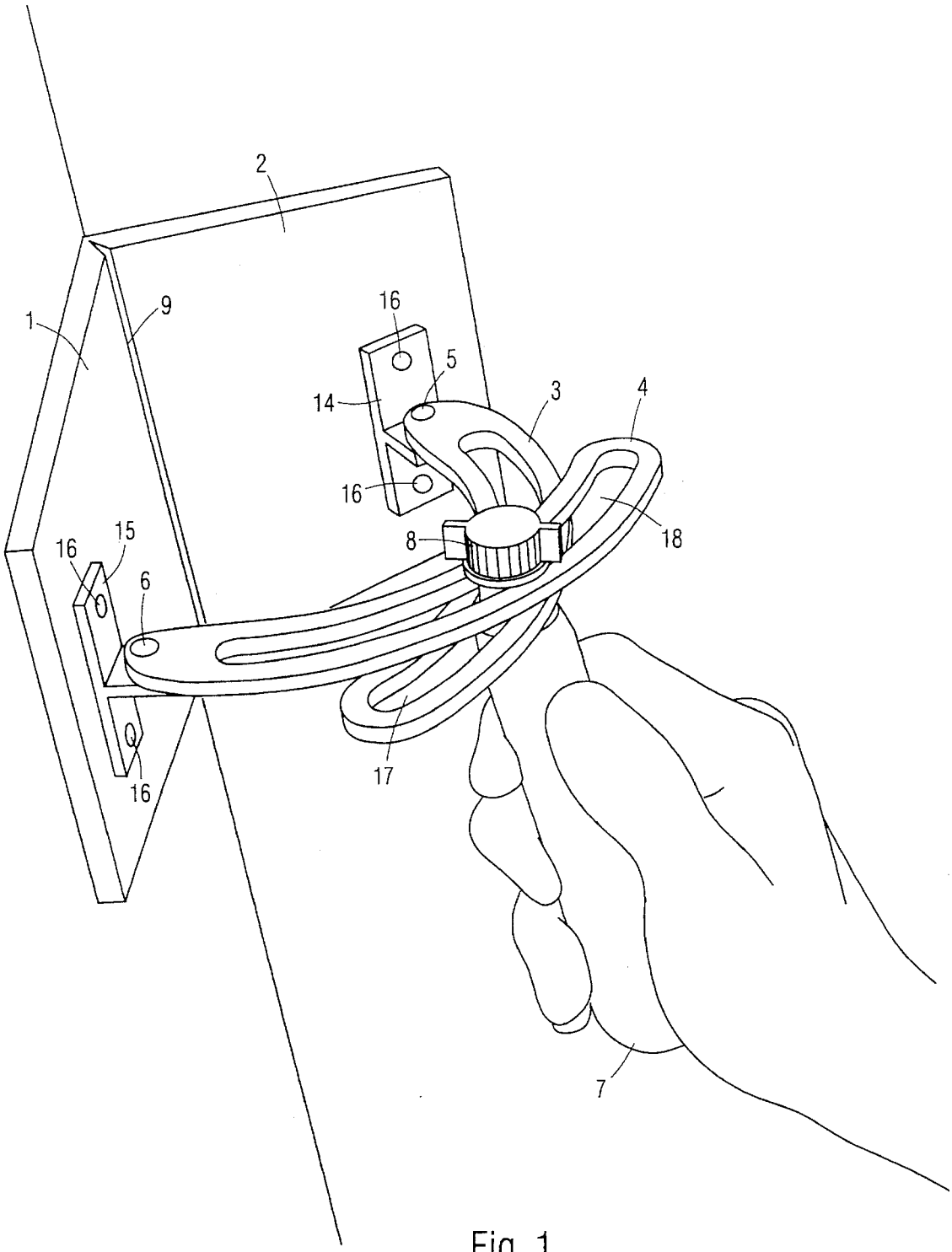
FIG. 1 is a side perspective view of a wall corner finishing tool in accordance with a preferred embodiment of the invention.

| Drawing Reference Numerals | |
|---|---|
| 1. Blade | 2. Blade |
| 3. Arcuate Arm | 4. Arcuate Arm |

-continued

| Drawing Reference Numerals | |
|---|---|
| 5. Pin | 6. Pin |
| 7. Handle | 8. Screw |
| 9. Living Hinge | 10. External Wall Corner |
| 11. Flat Wall | 12. Internal Wall Corner |
| 14. Bracket | 15. Bracket |
| 16. Snap Fasteners | 17. Opening |
| 18. Opening | |

DESCRIPTION OF THE PREFERRED EMBODIMENT

In accordance with a preferred embodiment of the invention shown in the side perspective view in FIG. 1, a wall corner finishing tool includes a pair of easy-to-clean plastic blades 1 and 2 each with a front working surface and a back surface. Blades 1 and 2 are connected by an integral living hinge 9 so as to provide a smooth continuation between their working surfaces. A pair of right-angled brackets 14 and 15 are attached to the back surfaces of blades 2 and 1, respectively, by snap fasteners 16. The proximal ends of a pair of arcuate arms 3 and 4 are hingeably attached to brackets 14 and 15, respectively, by pins 5 and 6, respectively. Arms 3 and 4 include longitudinal openings 17 and 18, respectively. Arms 3 and 4 extend toward each other and overlap at their intersection. A fastener or screw 8 is positioned through openings 17 and 18 at the intersection of arms 3 and 4, and tightened into one end of a handle 7. When worn, blades 1 and 2 can be easily detached from brackets 15 and 14 and replaced with new ones.

The angle between the from working surfaces of blades 1 and 2 can be adjusted by loosening screw 8, sliding arms 3 and 4 toward or away from each other until the desired angle is reached, and tightening screw 8 again. In this embodiment, the blade angle can be adjusted between 20 and 340 degrees for finishing a great variety of wall corners.

Figure 2:
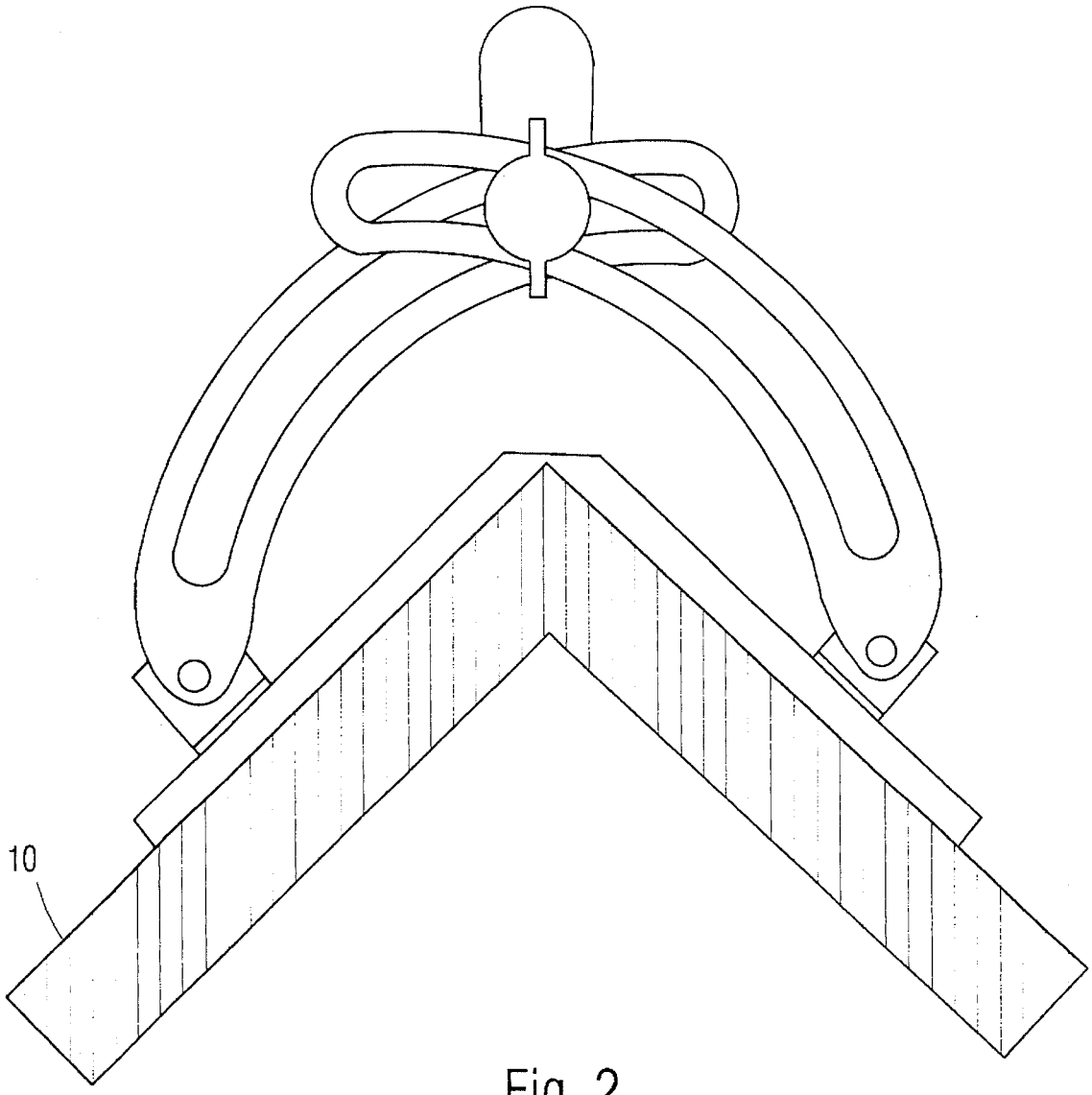
FIG. 2 is a top view of the tool adjusted to finish an external wall corner.
Figure 3:
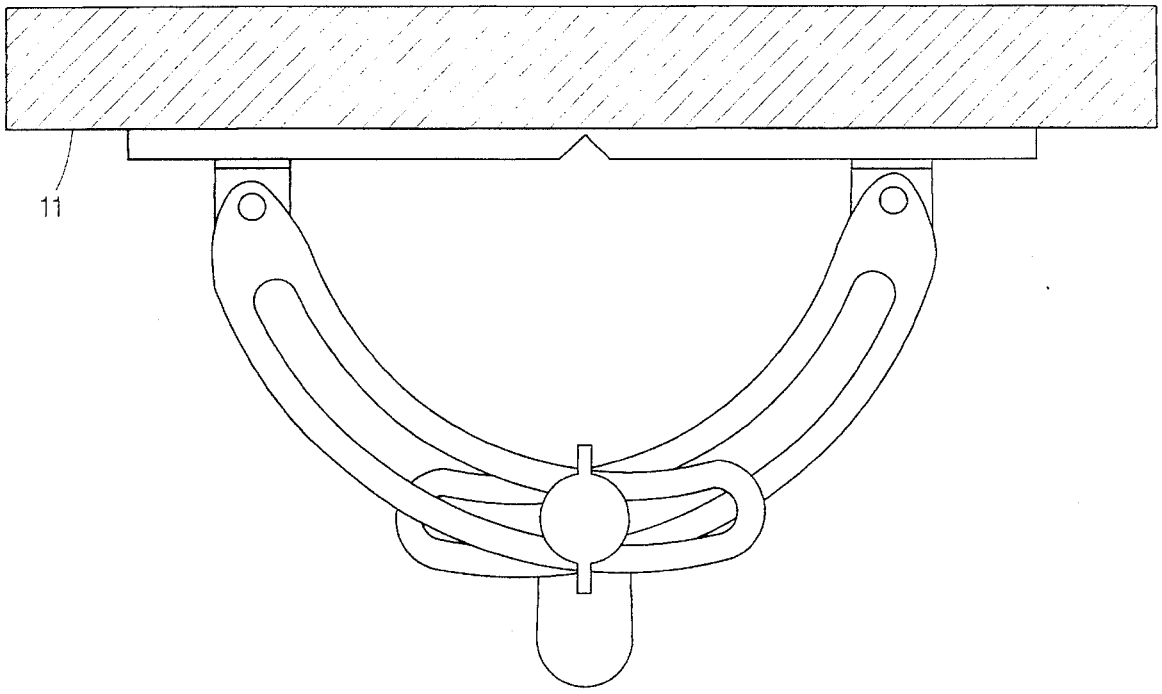
FIG. 3 is a top view of the tool adjusted to finish a flat wall.
Figure 4:
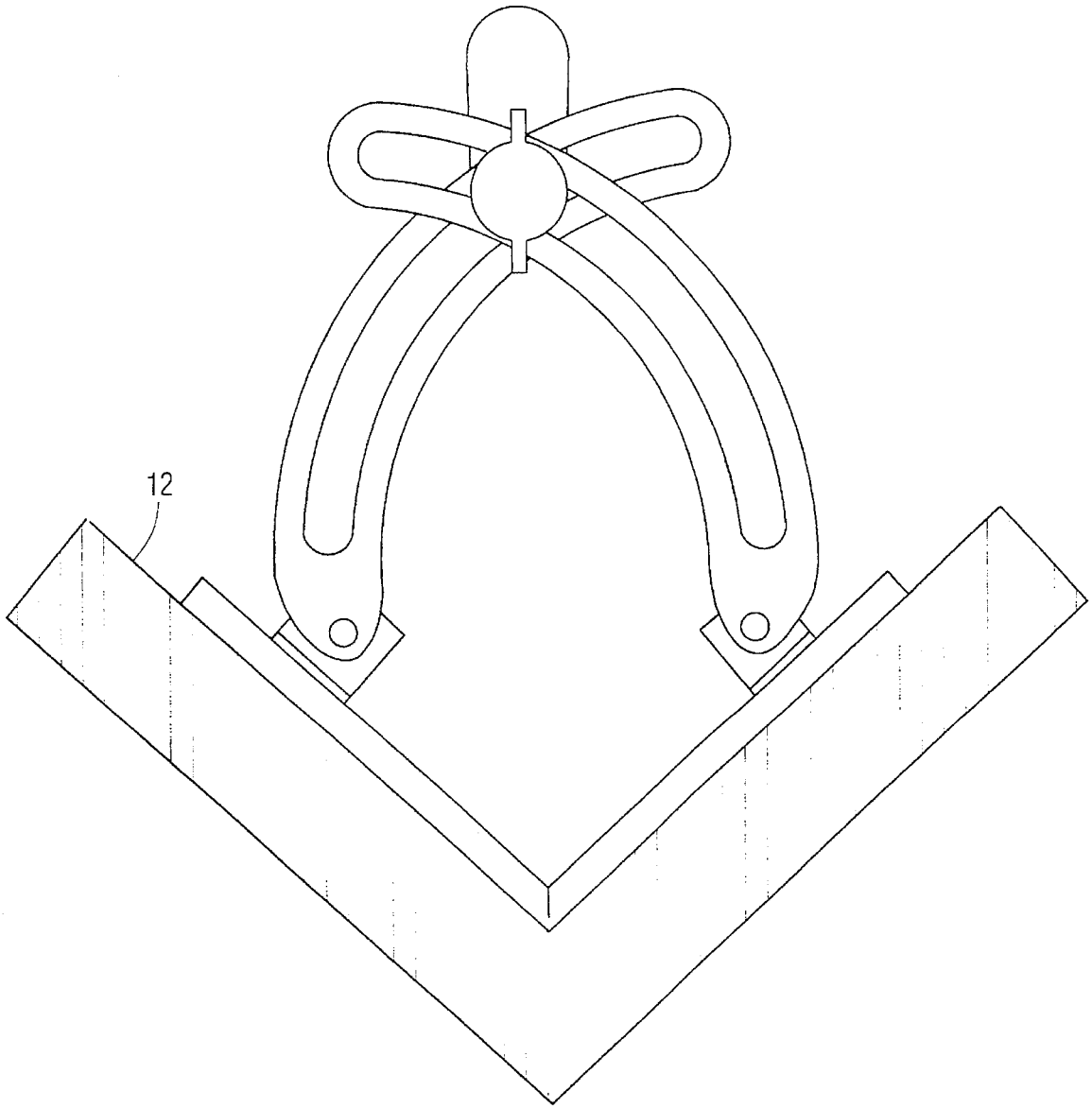
FIG. 4 is a top view of the tool adjusted to finish an internal wall corner.

The finishing tool is shown in FIGS. 2, 3, and 4 as being adjusted for finishing an external wall corner 10, a flat wall 11, and an internal wall corner 12, respectively.

Figure 5:
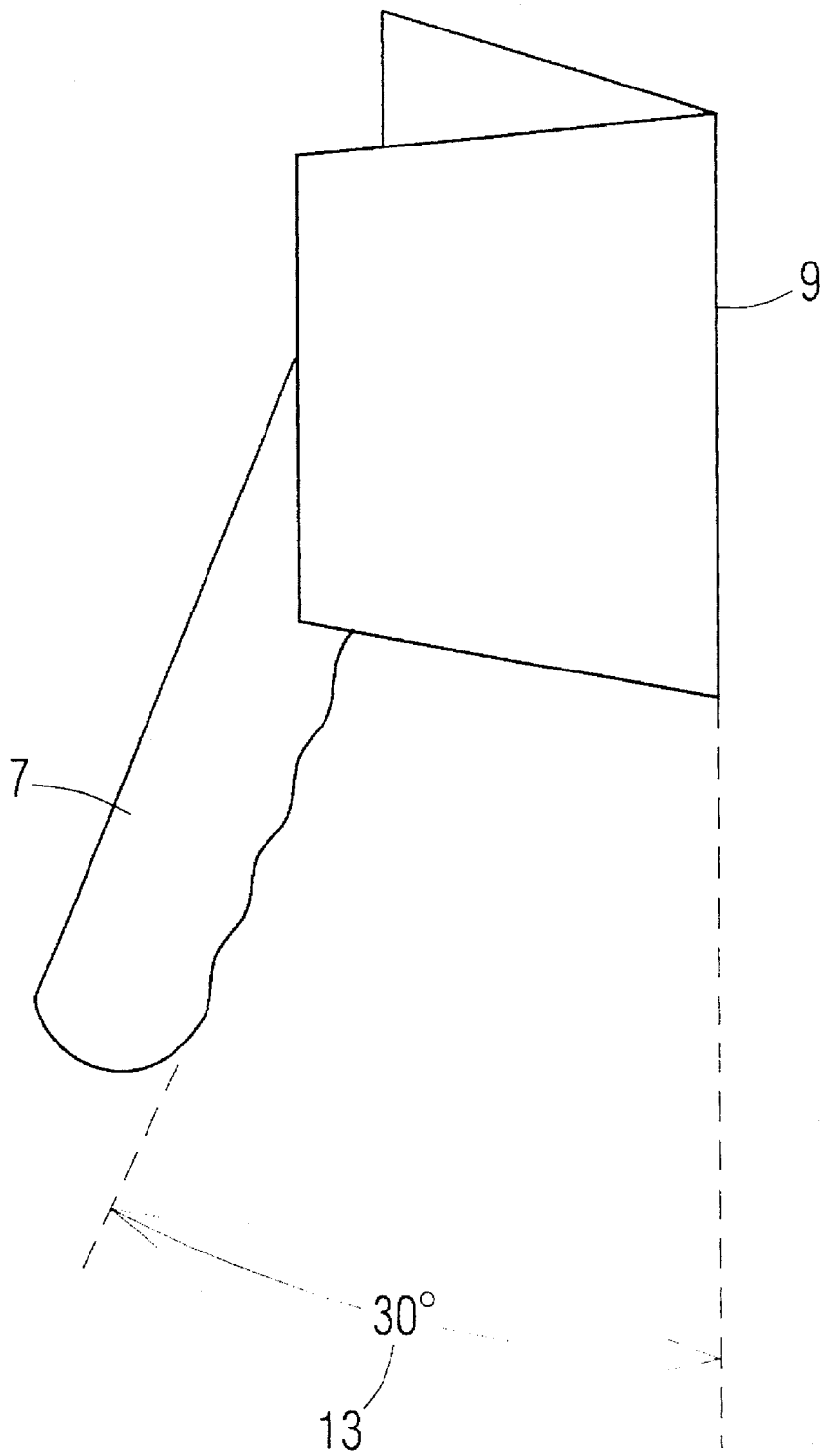
FIG. 5 is a side view of the tool illustrating the angle of its handle relative to its hinge.

As shown in FIG. 5, the angle between handle 7 and hinge 9 is about 30 degrees for comfortable handling.

What is claimed is:

1. A wall finishing tool, comprising:

a pair of hingeably connected blades, each blade having a front working surface and a back surface;

a pair of arcuate arms each having one end pivotally connected to said back surface of one of said blades, each arm having a longitudinal opening extending therethrough, said arms extending toward each other so as to intersect each other opposite said back surfaces of said blades; and adjustable fastening means extending through said openings of said arms at the intersection thereof for fastening said arms together, so that when said fastening means is loosened, said arms are movable relative to each other for adjusting an angle between said front working surfaces of said blades, and when said blades are adjusted to a desired angle, said fastening means is tightenable for fastening said arms together.

2. The wall finishing tool of claim 1 wherein said blades are connected by a living hinge, so as to provide a smooth continuation between said front working surfaces of said blades.

3. The wall finishing tool of claim 1 wherein said angle between said front working surfaces of said blades are adjustable between 20 to 340 degrees.

4. A wall finishing tool, comprising:

a pair of hingeably connected blades, each blade having a from working surface and a back surface;

a pair of arcuate arms each having one end pivotally connected to said back surface of one of said blades, each arm having a longitudinal opening extending therethrough, said arms extending toward each other so as to intersect each other opposite said back surfaces of said blades;

a handle having one end positioned against the intersection of said arms; and adjustable fastening means extending through said openings of said arms at the intersection thereof for fastening said handle thereto, so that when said fastening means is loosened, said arms are movable relative to each other for adjusting an angle between said front working surfaces of said blades, and when said blades are adjusted to a desired angle, said fastening means is tightenable for fastening said arms together.

5. The wall finishing tool of claim 4 wherein said blades are connected by a living hinge, so as to provide a smooth continuation between said front working surfaces of said blades.

6. The wall finishing tool of claim 4 wherein said angle between said front working surfaces of said blades are adjustable between 20 to 340 degrees.

7. A wall finishing tool, comprising:

a pair of hingeably connected blades, each blade having a front working surface and a back surface;

a pair of arcuate arms each having one end pivotally connected to said back surface of one of said blades, each arm having a longitudinal opening extending therethrough, said arms extending toward each other so as to intersect each other opposite said back surfaces of said blades;

a handle having one end positioned against the intersection of said arms; and a screw extending through said openings of said arms at the intersection thereof and into said one end of said handle, so that when said screw is loosened, said arms are movable relative to each other for adjusting an angle between said front working surfaces of said blades, and when said blades are adjusted to a desired angle, said screw is tightenable for fastening said arms together.

8. The wall finishing tool of claim 7 wherein said blades are connected by a living hinge, so as to provide a smooth continuation between said front working surfaces of said blades.

9. The wall finishing tool of claim 7 wherein said angle between said working surfaces of said blades are adjustable between 20 to 340 degrees.

* * * * *